US007383619B2

(12) United States Patent
Gross et al.

(10) Patent No.: US 7,383,619 B2
(45) Date of Patent: Jun. 10, 2008

(54) HANDLE BODY FOR BODY CARE IMPLEMENTS

(75) Inventors: Peter Gross, Sempach (CH); Martin Zwimpfer, Lucerne (CH)

(73) Assignee: Trisa Holding AG, Triengen (CH)

( * ) Notice: Subject to any disclaimer, the term of this patent is extended or adjusted under 35 U.S.C. 154(b) by 0 days.

(21) Appl. No.: 11/386,889

(22) Filed: Mar. 23, 2006

(65) Prior Publication Data

US 2006/0213018 A1 Sep. 28, 2006

Related U.S. Application Data

(63) Continuation of application No. PCT/EP2004/12521, filed on Nov. 5, 2004.

(30) Foreign Application Priority Data

Nov. 18, 2003 (EP) ..... 0302676

(51) Int. Cl.
*A46B 5/02* (2006.01)
*B25G 1/00* (2006.01)

(52) U.S. Cl. ..... 16/430; 15/167.1; 15/143.1

(58) Field of Classification Search ..... 15/167.1, 15/143.1; 16/430, DIG. 19
See application file for complete search history.

(56) References Cited

U.S. PATENT DOCUMENTS

| | | | | |
|---|---|---|---|---|
| 1,899,242 | A | 2/1933 | McNab | |
| 2,360,745 | A | 10/1944 | Vogel | |
| 5,052,071 | A * | 10/1991 | Halm | 15/167.1 |
| 5,398,369 | A * | 3/1995 | Heinzelman et al. | 15/167.1 |
| 5,687,485 | A * | 11/1997 | Shurtleff et al. | 30/526 |
| 5,781,958 | A | 7/1998 | Meessmann et al. | |
| 5,862,571 | A * | 1/1999 | Naft et al. | 16/436 |
| 5,890,296 | A * | 4/1999 | Metcalf et al. | 30/526 |
| 6,024,903 | A | 2/2000 | Naft et al. | |
| 6,108,869 | A | 8/2000 | Meessmann et al. | |
| 6,234,789 | B1 | 5/2001 | Beals et al. | |
| 6,298,516 | B1 | 10/2001 | Beals et al. | |
| 6,332,233 | B1 * | 12/2001 | Proulx | 15/167.1 |
| 6,408,476 | B1 * | 6/2002 | Cann | 15/167.1 |
| 7,047,591 | B2 * | 5/2006 | Hohlbein | 15/143.1 |
| 2002/0138931 | A1 * | 10/2002 | Davies | 15/167.1 |
| 2002/0170145 | A1 * | 11/2002 | Stvartak et al. | 16/430 |
| 2003/0009837 | A1 | 1/2003 | Cann | |
| 2004/0006837 | A1 | 1/2004 | Cann | |
| 2004/0025272 | A1 | 2/2004 | Stvartak et al. | |

FOREIGN PATENT DOCUMENTS

| | | |
|---|---|---|
| DE | 608 820 | 2/1935 |
| DE | 36 22 596 A1 | 1/1987 |
| DE | 42 22 931 | 12/1993 |
| FR | 1 005 685 | 4/1952 |
| WO | WO 97/25899 A1 | 7/1997 |
| WO | WO 01/17391 A1 | 3/2001 |
| WO | WO 02/078489 A1 | 10/2002 |

* cited by examiner

*Primary Examiner*—Robert J. Sandy
(74) *Attorney, Agent, or Firm*—Oliff & Berridge, PLC

(57) ABSTRACT

The invention relates to a handle body for body care implements, such as toothbrushes, hairbrushes, razors, etc. having a skeleton form base structure formed from a hard component for supporting at least one soft component. The base structure includes a grip part with an elongate, spinal core arranged in the grip with protruding extensions in the form of ribs and/or stump-like raised parts that form open spaces filled with the soft component.

25 Claims, 10 Drawing Sheets

HANDLE BODY FOR BODY CARE IMPLEMENTS

CROSS-REFERENCE TO RELATED APPLICATIONS

This is a Continuation of PCT/EP2004/012521 filed Nov. 5, 2004, which claims the benefit of European Patent Application No. 03026376.8 filed Nov. 18, 2003. The entire disclosure of the prior applications is hereby incorporated by reference herein in its entirety.

BACKGROUND

The invention relates to a handle body for body care implements, such as toothbrushes, hairbrushes, razors, etc.

In the document WO-A-02/078489 there is a description of a toothbrush that is provided with a head and a handle comprising a hard plastic component. Formed on the surface of the handle are raised parts with a border of soft-elastic material.

U.S. Pat. No. 6,298,516 discloses a toothbrush with a brush body and a brush head, the brush body having a handle which has two elastic elements. The first elastic element covers over the free end region of the handle, in particular where the grip is in contact with the inner surface of the hand during use. The second elastic element serves as a rest for the thumb. The elastic elements preferably consist of a thermoplastic elastomer.

A toothbrush made of plastic with a ribbed handle and an indentation for receiving the thumb of a user is described in DE-C-4222931. The handle of the toothbrush has a core, which bears ribs which are spaced apart from one another and altogether form an adequate gripping surface. The ribs have a substantially disk-shaped form.

SUMMARY

An object is to provide a handle body for a body care implement, in particular for a toothbrush, a hairbrush or a razor, with improved holding comfort during use for different forms of hands and fingers, different hand postures and cleaning positions.

The basic idea of the handle body is to provide the handle body with a skeletal, preferably asymmetric, base structure comprising a hard component with a core and space-defining extensions for receiving and supporting an elastic soft component. The extensions have the form of ribs and stub-like raised parts. They protrude from the core at irregular intervals, preferably asymmetrically, and are designed in such a way that the forces occurring during conventional use of a toothbrush, hairbrush or razor provided with a handle body of this type are transmitted from the hand to the core of the base structure. Webs which are located between the ribs in the grip part of the handle body bring about increased flexibility of the grip part and thereby make it possible to adapt the base structure to different hand postures. In this way, improved handling of the handle body in various gripping positions is ensured, for instance during cleaning, brushing or shaving various regions of the human or animal body, when used by lefthanded or righthanded people and also people whose hands and fingers differ in size.

The soft component fills the spaces formed by the extensions and covers over virtually the entire surface of the handle. The preferably structured surface of the soft component provides a soft, flexible, absorbent and non-slip gripping surface. The pleasing feel of the handle together with the flexible base structure brings about significantly improved comfort during use when holding the handle body in connection with a toothbrush, a hairbrush, a razor or some other body care implement.

In further preferred embodiments, the structured surface of the soft component is also extended to the head and/or the neck of the handle body. In this case, corresponding structure elements of the soft element serve as cleaning and massage surfaces for tongues, gums, lips etc. Apart from use for toothbrushes, the handle body according to the invention with the structure elements of the soft component may also be used for electric toothbrushes and other everyday body care articles, such as razors, hairbrushes etc.

BRIEF DESCRIPTION OF THE DRAWINGS

Particularly advantageous embodiments are schematically represented in the following figures, in which specifically:

FIGS. 18*a*-27*a* show schematic longitudinal sections along sectional planes E18-E27 depicted in FIG. 18 to FIG. 27;

FIG. 18*b*-27*b* show perspective views of details represented in FIG. 18 to FIG. 27 from plan views of gripping surfaces;

DETAILED DESCRIPTION OF EMBODIMENTS

Figure 1:
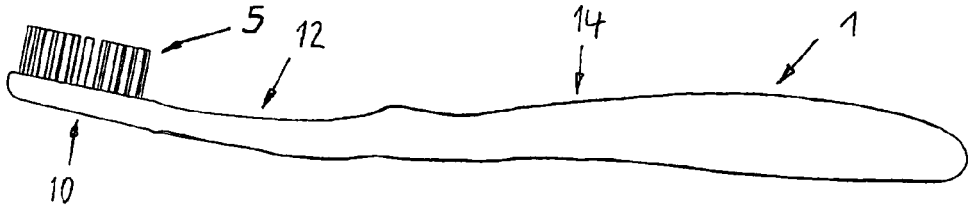
FIG. 1 shows a schematic outline of a toothbrush according to the invention.

FIG. 1 shows a schematic outline of the toothbrush according to the invention. Its toothbrush body 1 represents an embodiment of a handle body according to the invention for body care implements and is provided with a head 10, intended for bearing bristles 5, a neck 12 and a grip 14, adjoining the latter. As described below in FIGS. 2 and 5 in detail, the toothbrush body 1 comprises at least one hard component 16, which is formed as a base structure 18 for receiving and supporting at least one soft component 20.

Figure 2:
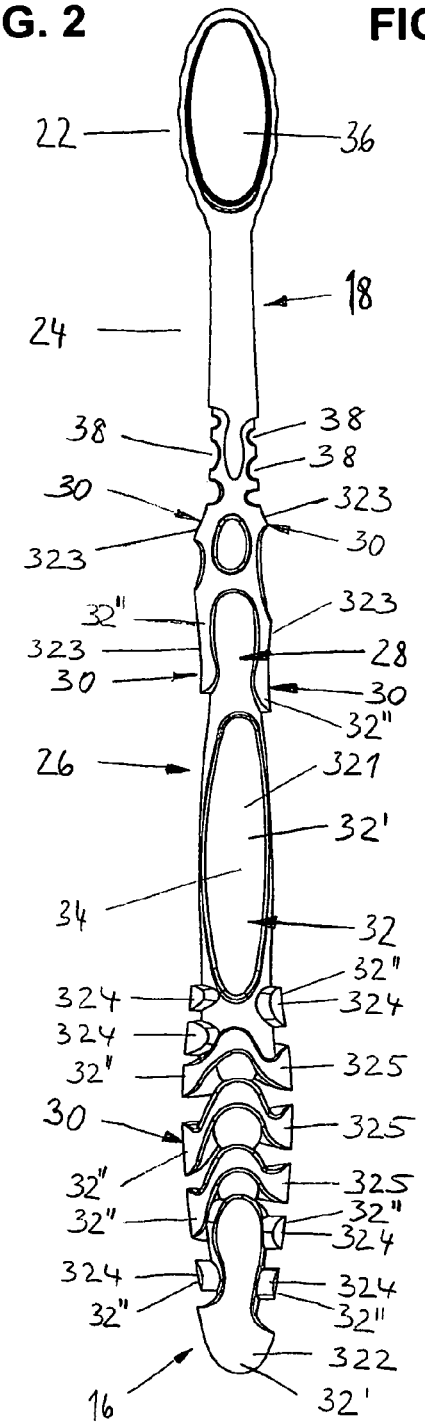
FIG. 2 shows a plan view of the upper side of a base structure of a toothbrush body according to the invention.
Figure 3:
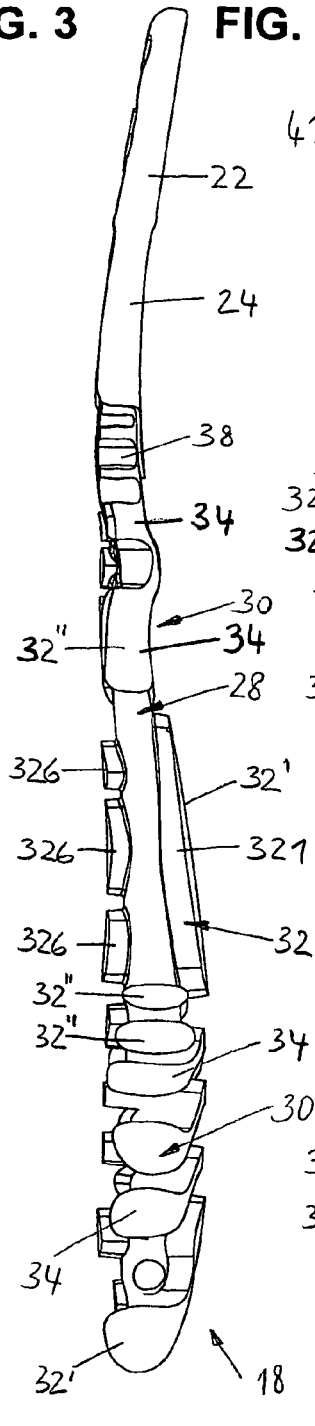
FIG. 3 shows a side view of the base structure of the toothbrush body from FIG. 2.
Figure 4:
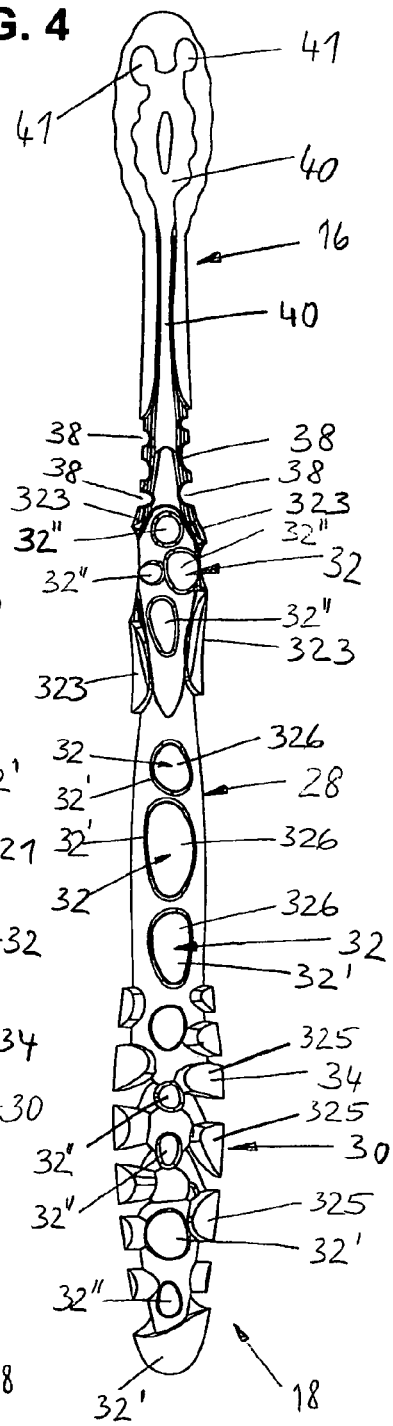
FIG. 4 shows a plan view of the underside of the base structure of the toothbrush body from FIG. 2.

In FIGS. 2 to 4, various views of an embodiment according to the invention of the base structure 18 are represented. By analogy with the toothbrush body 1, the skeletal base structure 18 is also divided into a head part 22, a neck part 24 and a grip part 26. The grip part 26 has an elongate, spinal core 28 running centrally in the grip 14.

Protruding from the core 28 are extensions 30, 32, 32', 32" in the form of ribs 30, which are offset with respect to one another in the longitudinal direction of the grip part 26 and form open spaces, and stub-like raised parts 32. Like the raised parts 32, the ribs 30 are formed asymmetrically with respect to the longitudinal axis of the core 28 and unevenly distributed in the grip part 26 of the toothbrush body 1. On the basis of their height, it is possible to distinguish between two groups of extensions 30, 32, 32', 32": in the case of a first group, extensions 32' reach as far as the surface of the grip 14, so that their outer faces 34 themselves form part of the gripping surface of a complete toothbrush. In the case of a second group of extensions 32", the height is smaller, so that on the ready-to-use toothbrush their radial outer faces 34 are covered over by the soft component 20.

In FIG. 2, an extension 321 with an oval outer face 34, arranged approximately in the middle of the grip part, and an extension 322, forming the end piece of the grip part 26, are shown, these extensions belonging to the group of extensions 32'. A further four ribs 323, arranged near the neck part 24, and also nine ribs 324, 325, arranged at the free end of the grip part 26, belong to the extensions 32". Special mention should be made of the ribs 325 in the region of the rest for the ball of the hand, which enclose an angle at the periphery of at least 180° to at most 360°, preferably of 270°, about the longitudinal axis of the toothbrush and have a wave-shaped peripheral line. On the underside of the toothbrush, in the preferably remaining openings of the ribs 325, there are an extension 32' and three further extensions 32" (FIG. 4). Arranged opposite the extension 321 of the upper side are three extensions 32", which are designated by 326. Formed at the neck region of the grip part 26, in the free peripheral region between the ribs 323, are four extensions 32".

The extensions 30, 32, 32', 32" have radially outer, preferably smooth outer faces 34 with a round, oval, reniform or otherwise rounded shape.

The core 28 of the grip part 26 continues into the neck part 24 and the spade-like head part 22. A recess 36 in the head part 22 is intended for receiving bristles 5 or a bristle carrier 7. As FIG. 2 and FIG. 4 illustrate particularly well, to reduce the flexural rigidity, the neck part 24 laterally has five mutually offset, half-cylindrical indentations 38, which on the ready-to-use toothbrush are filled with the soft component 20. The lateral indentations 38 create a flexible zone with a reduced flexural rigidity in the lateral direction. Under the same loading, the amount of deflection of the head part 22 with respect to the grip part 26 is greater with a lateral point of application than with a point of application on the upper side or underside of the toothbrush.

Represented in FIG. 4 is a channel-like depression 40, which extends on the underside of the toothbrush body 1 from the beginning of the neck part 24 on the grip side to the free end region of the head part 22. On the head part 22, the depression 40 divides into two channel arms, which are brought together once again in the direction of the free head and, in order subsequently to end in two circular depressions 41. The depressions 40, 41 receive the elastic soft component 20. The surface of the soft component 20 of the head 10 is formed as a tongue scraper 42 for cleaning the tongue and for massaging the gums.

Used in particular as the hard component 16 for the base structure 18 are the materials styrene and styrene acrylonitrile (SAN), polystyrene (PS), polyethylene terephthalate (PET), acrylonitrile butadiene styrene copolymers (ABS), polyethylene (PE) and preferably polypropylene (PP). On account of the complex formation of the base structure 18, a PP with a melt flow rate MFR of 2 g/10 min to 10 g/10 min, measured at a test temperature of 230° C. and under a load of 21.2 N, is particularly suitable for production in an injection-molding process.

Figure 5:
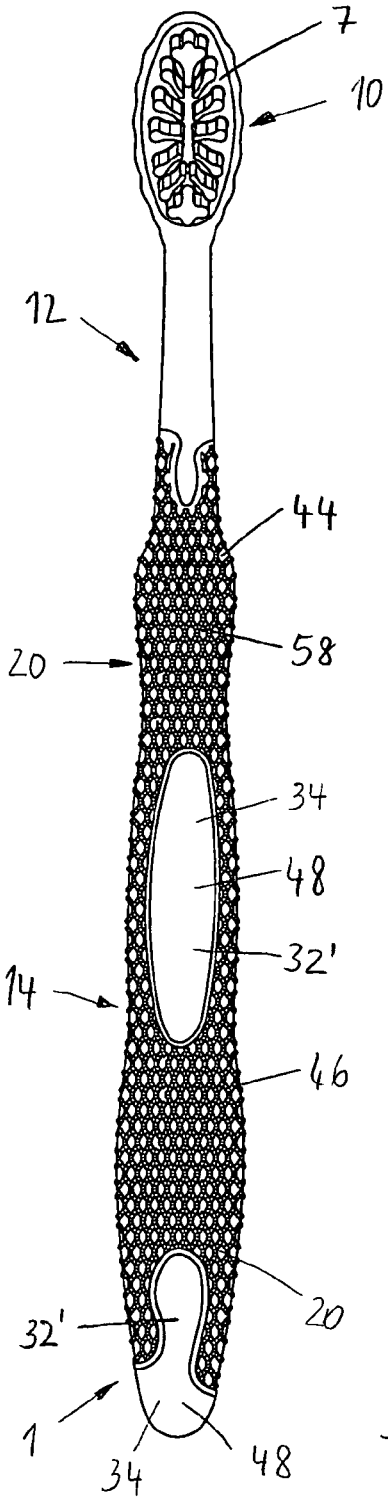
FIG. 5 shows a plan view of the upper side of a toothbrush with a base structure as shown in FIG. 2 to FIG. 4 and a honeycomb surface structure of the soft component.
Figure 6:
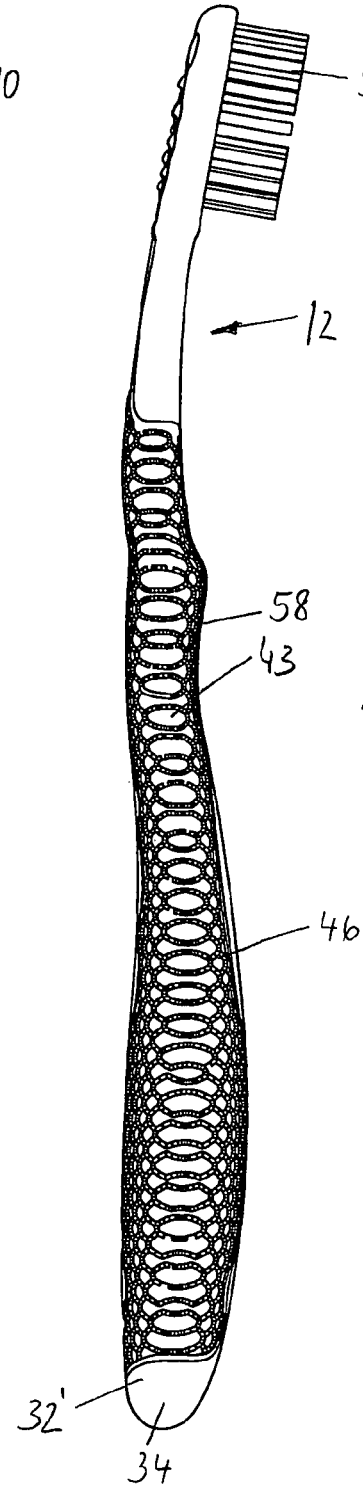
FIG. 6 shows a side view of the toothbrush according to FIG. 5, which has a laterally extended surface structure.
Figure 7:
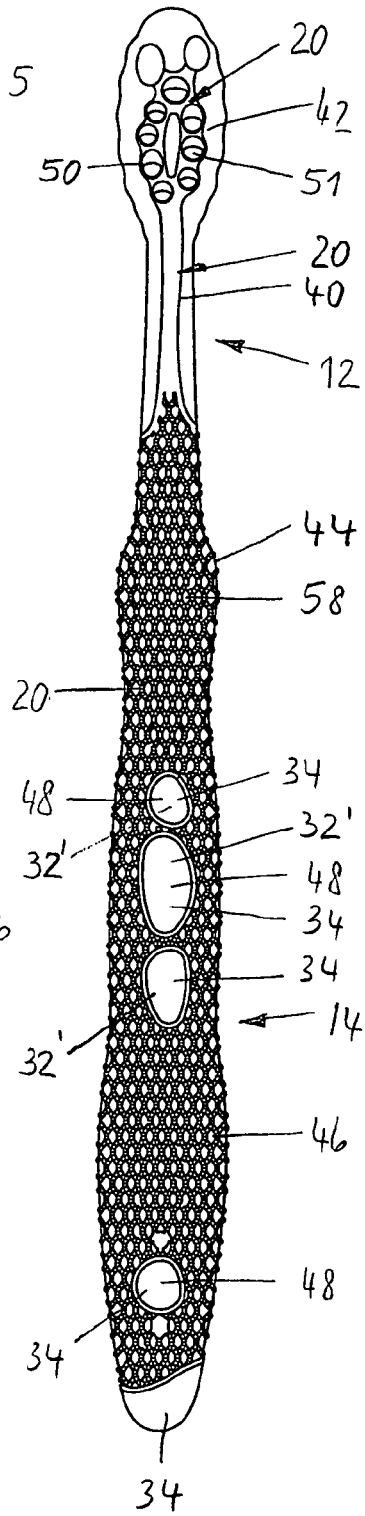
FIG. 7 shows a plan view of the underside of the toothbrush from FIG. 5 with a tongue scraper on the head.

In FIG. 5 to FIG. 7, views of a toothbrush according to the invention are shown. The toothbrush is made up of the toothbrush body 1 and the bristles 5 secured to the head 10. The toothbrush body 1 comprises the base structure 18, shown in FIG. 2 to FIG. 4, and the soft component 20 supported by the base structure 18.

The neck 12 of the toothbrush body 1 is slightly narrowed with respect to the head 10 and the grip 14. It begins in the direction of the head 10 after a widening 44 of the grip 14. The widening 44 serves as a rest for the thumb 58 and prevents the thumb from slipping in the direction of the head 10 during use of the toothbrush. As a proportion of the overall length of the toothbrush, the length of the head 10 is 10%-25%, the length of the neck 12 is 15%-30% and the length of the grip 14 is 45%-75%.

The soft component 20 fills the spaces in the base structure 18 formed by the extensions 30, 32, 32', 32". It completely covers the grip 14, with the exception of the outer faces 34 of the extensions 32'. The neck part 24 and the head part 22 are partly covered over, in particular at the indentations 38 and the depressions 40, 41. The coverage, and consequently the outer contour of the grip 14, is formed in such a way that there are no occurrences of projections, shoulders or other pronounced changes in direction that could lead to pressure points on the hand during use of the toothbrush.

The soft component 20 preferably has a surface structure 46 over virtually its entire outer surface. The soft component 20 has a maximum radial thickness of 10 mm and provides the user with a soft, flexible, absorbent and non-slip gripping surface. Preferably used as the soft component 20 are thermoplastic elastomers (TPE), which enter into an affinitive bond with the hard component 16. In order to ensure a soft, pleasing feel, a TPE with a Shore A hardness of less than 70, with particular preference with a Shore A hardness of below 50, is used.

In the case of the embodiment shown in FIG. 5 to FIG. 7, the surface of the soft component has a honeycomb structure 46 over the entire grip 14 and the start of the neck 12. As shown in FIG. 6, the surface structure 46 is continued from the upper side or underside continuously over the side surfaces, but is configured in an enlarged or extended manner, preferably in the peripheral direction. Apart from a honeycomb surface structure 46, as shown, other surface structures 46 are of course possible. Particularly advantageous configurations are depicted in FIG. 18 to FIG. 24 and are described in detail later.

On the surface of the grip 14, the outer faces 34 of the extensions 32' appear as islands 48. The islands 48 are surrounded by the soft component 20 and have an extent of at least 2 mm×2 mm, preferably at least 4 mm×4 mm. In the embodiment shown, the islands 48 have a smooth surface in the color of the main component 16. Alternatively, they may also be formed by a surface structure 46 identical or similar to the surrounding soft component 20 and/or covered with lettering, symbols etc., for example a company logo, or colored. The structure, lettering, symbols etc. may be applied by known technology, such as hot embossing or pad printing.

At the edges, the islands 48 go over virtually steplessly and continuously into the soft component 20. The extensions 32', the outer faces 34 of which form the islands 48, perform in particular a technical task in the production process of the toothbrush. In the preferably used technique of molding on the soft component 20, they serve the purpose of fixing the base structure 18 in a defined position within an injection mold.

As a difference from the extensions 32', the radial outer faces 34 of the extensions 32" are covered over by a film-like layer, 1 mm to 4 mm thick, of the soft component 20. They are not depicted in these schematic representations in order to restrict the number of details shown in FIG. 5 to FIG. 7 so as to maintain an overview.

Figure 8:
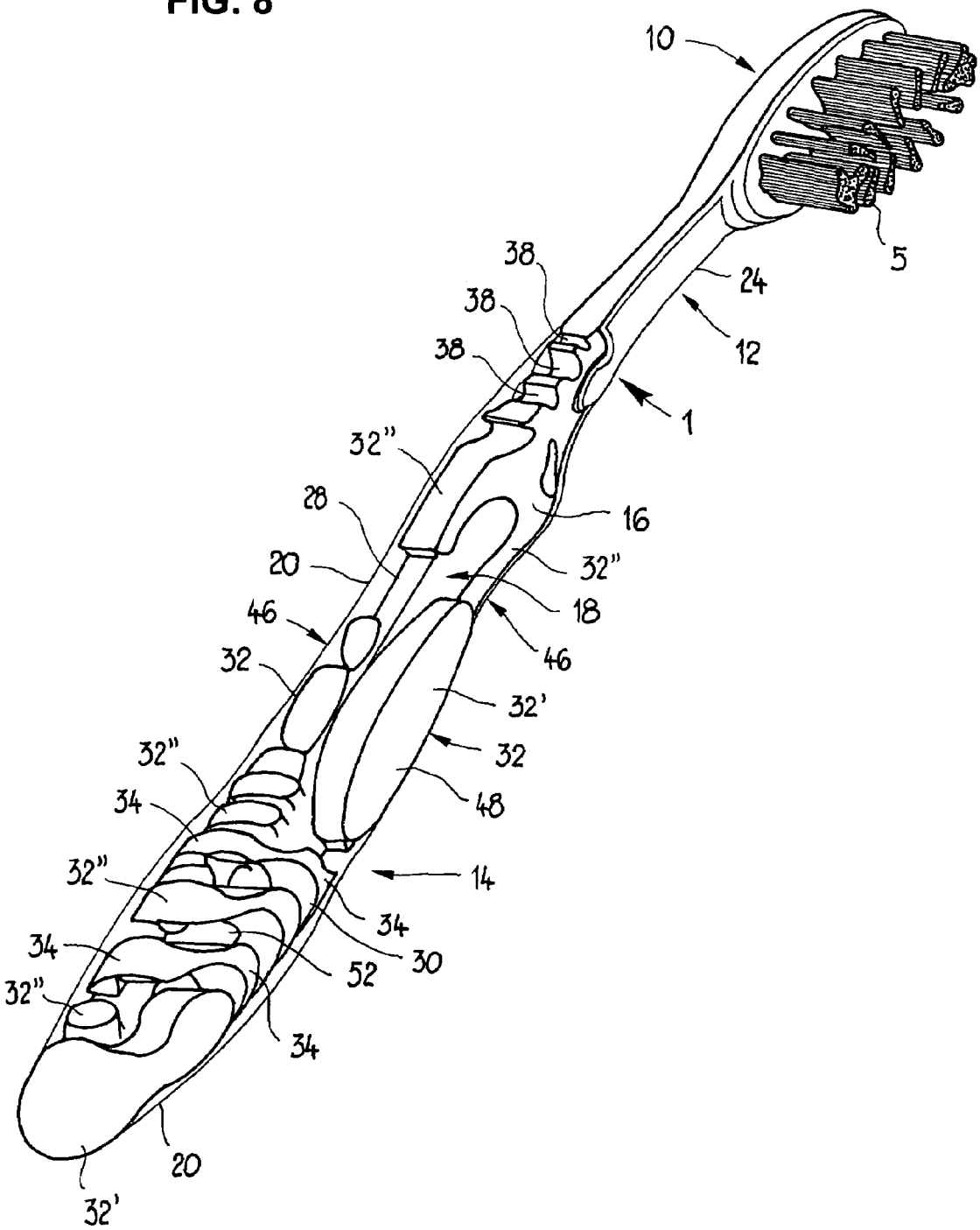
FIG. 8 shows a perspective view of the toothbrush shown in FIG. 5 to FIG. 7 with a transparent soft component and with the base structure according to FIG. 2 to FIG. 4.

According to FIG. 7, scraper protuberances 50 are formed from the soft component 20 on the underside of the head part 22. They form a tongue scraper 42, which serves for keeping the tongue clean and massaging it. Its scraper protuberances 50 form an elliptical or circular base area and part-circular scraper area 51 with a spoon-like concavity for improved reception and removal of scraped-off material. The scraper protuberances 50 are arranged offset from one another above the channel-like depressions 40 in the head part 22. The height of the scraper protuberances 50 is at most 3 mm. Alternatively, the scraper protuberances 50 shown in FIG. 7 may also be partly or completely replaced by differently formed surface structures 46, for example like those represented in FIG. 18 to FIG. 27. The surface structures 46 shown there may be provided both on the head 10 and on the neck 12. Preferably, the raised surface structures 46 on the head 10 protrude somewhat further from the surface of the head 10 than the corresponding structures in the region of the grip. In order to produce a good cleaning and massaging action, the surface structures 46 project up to 3 mm away from the surface of the head 10. The surface structures 46 may in this case be provided not only on the rear side of the head, opposite from the bristles 5, but also on the front side of the head, covered with bristles 5, and in this case optionally also under the bristles 5. Blind holes for receiving the conventional bristles 5 are then surrounded by the surface structures 46. In FIG. 8, the toothbrush shown in FIG. 5 to FIG. 7 is represented with a transparent soft component 20. Through the soft component 20 there can be seen the extensions 32" covered over by it, the core 28 and the indentations 38 on the neck part 24. The outer faces 34 of the extensions 32" can also be felt by the user, in spite of the coverage by the soft component 20. Therefore, with a pleasing feel on account of the continuous surface of the soft component 20, precise guidance of the toothbrush is ensured even in different cleaning positions.

The regions of the toothbrush that are covered by a radially thicker layer of the soft component 20 appear darker than those that are only covered over by a thin layer on account of the shadow effect produced by surrounding extensions 30, 32, 32', 32". This effect of depth can be increased by use of a slightly colored material for the soft component 20. The user identifies from regions of the soft component 20 that appear darker the positions at which the cross section of the core 28 has a particularly small diameter, and the toothbrush consequently has a more flexible and softer/grippier zone. With more frequent use of the toothbrush, the darker regions are intuitively associated by the user with an increased elasticity and flexibility.

Figure 9:
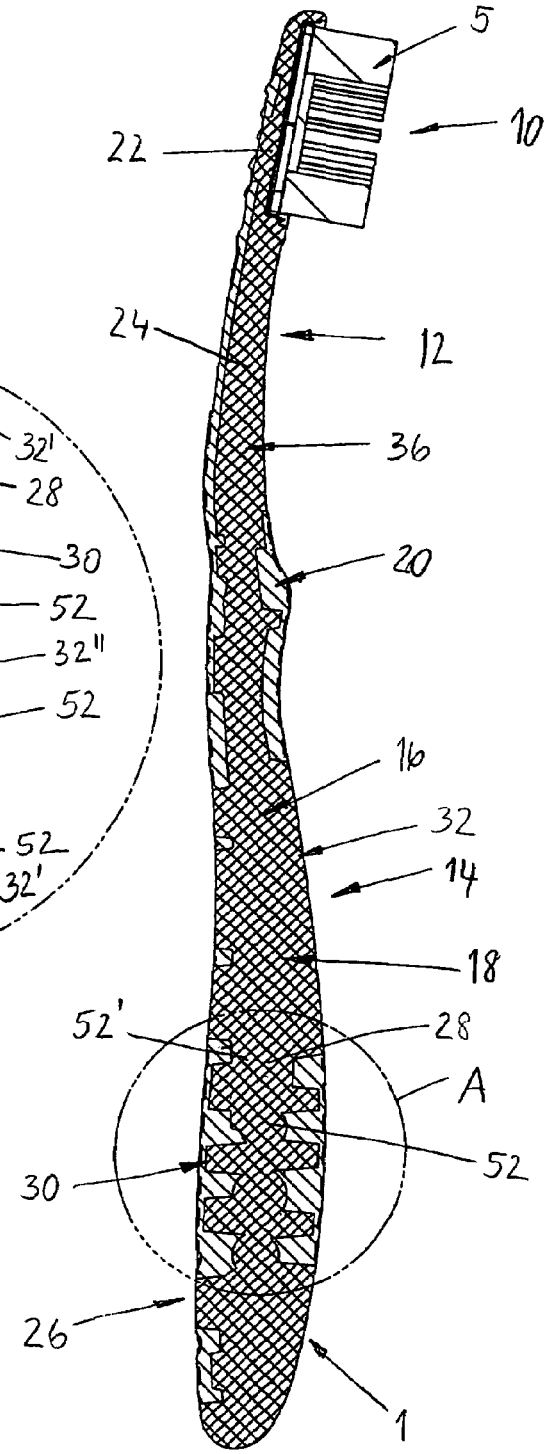
FIG. 9 shows a longitudinal section through the toothbrush shown in FIG. 8.
Figure 10:
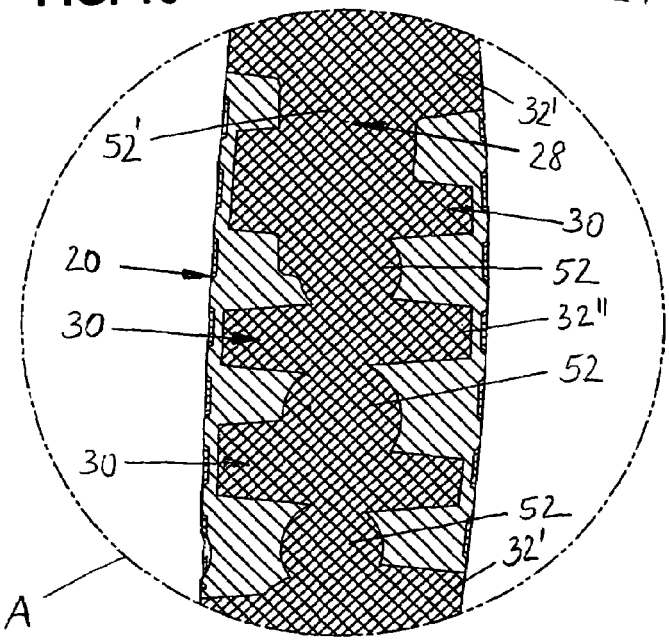
FIG. 10 shows an enlarged sectional representation of the detail A from FIG. 9.

In FIG. 9, a section along the longitudinal axis of the toothbrush shown in FIG. 5 to FIG. 8 is represented. There, as also in the enlarged detail A in FIG. 10, the regions of the core 28 between the ribs 30 can be seen particularly well. In these regions, the core 28 is formed as a part-spherical web 52 or as a part-cylindrical web 52'. The webs 52, 52' are represented in FIG. 9 and FIG. 10 as parts of a circle or trapezoids between the likewise trapezoidal sections of the ribs 30 protruding from the core 28. The webs 52, 52' may alternatively also have other forms, weakened with respect to the maximum cross section of the core 28. The length of the webs 52, 52' is 3 mm to 8 mm. The volume of the spaces which are formed between the webs 52 by the ribs 30 is preferably completely filled with the soft component 20 and is between 500 $mm^3$ and 2500 $mm^3$, preferably approximately 1500 $mm^3$. The extensions 32, 32', 32" preferably have a relatively sharp delimitation with respect to the surrounding soft component 20. This is achieved by the extensions 32, 32', 32" being formed by relatively steep walls, which enclose an angle of below 30°, preferably of below 10°, with an assigned perpendicular to the longitudinal axis of the grip 14. This angle of rise is preferably already reached within a distance of below 2 mm, measured from the radially inner root of the extensions 32, 32', 32". The clear separation between the extensions 32, 32', 32" and the translucent soft component 20 allows the user to identify immediately the flexible and soft locations in the region of the grip 14.

Adaptation of the distances between the extensions 30, 32, 32', 32" or the form of the webs 52, 52' and extensions 30, 32, 32', 32" allows the degree and direction of the flexural rigidity to be individually fixed for each region of the toothbrush. On account of the asymmetric base structure 18 and the soft component 20 surrounding it in a complementary manner, the flexural rigidity varies along the longitudinal axis of the toothbrush and similarly, in dependence on the angle at the periphery, perpendicularly to the longitudinal axis of the toothbrush. For this reason, for example with the grip 26 restrained and the same loading, the deflection of the head 10 at a lateral point of application is less than with a point of application on the upper side, covered with bristles, or the opposite underside.

Figure 11:
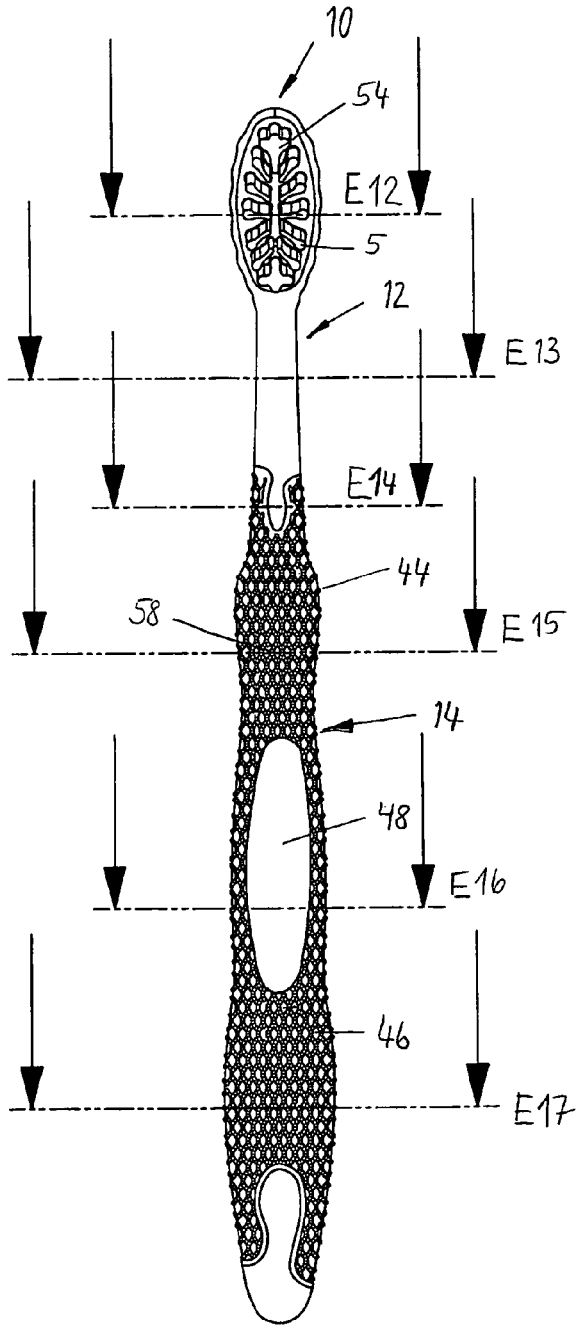
FIG. 11 shows a plan view of the toothbrush according to FIG. 5 to FIG. 7 with markings of cross-sectional planes E12 to E17.

In FIG. 11, the toothbrush already shown in FIG. 5 to FIG. 10 is provided with markings E12 to E17 of cross-sectional planes perpendicular to its longitudinal axis. These planes relate to the cross sections depicted alongside in FIG. 12 to FIG. 17.

In FIG. 11, bristle clusters 54 represented on the head 10 of the toothbrush are symmetrical with respect to a plane which runs through the longitudinal axis of the toothbrush and is parallel to the bristles 5. The bristle clusters 54 have an organically formed base area with part-symmetry with respect to their principal axes. As an alternative to the symmetrical distribution of the bristle clusters 54 with respect to the longitudinal axis that are shown in FIG. 11, the arrangement may also be made part-symmetrical or asymmetric. Both the form of their preferably rounded base areas and the specific arrangement on the head 10 makes allowance for different forms of teeth. The bristle clusters 54 preferably have a greater cross section in their outer edge region than in the center. They may have bristles 5 of various degrees of hardness with colors respectively assigned to them. Preferably, the distribution of the degrees of hardness and colors is made radially symmetrical about the center of a bristle cluster 54. In addition, the bristles 5 in the edge region of a bristle cluster 54 preferably have a greater diameter than bristles 5 arranged centrally in the bristle cluster 54. The described distributions of degrees of hardness and colors may also be continued over the entire bristle arrangement, made up of bristle clusters 54.

Depicted in FIG. 12 to FIG. 17 are cross sections perpendicular to the longitudinal axis of the toothbrush shown in FIG. 11 along the cross-sectional planes E12 to E17 marked there. The hard component 16 is represented in a cross-hatched manner in FIG. 12 to FIG. 17. The soft component 20 is identified by a simple diagonal hatching.

Figure 12:
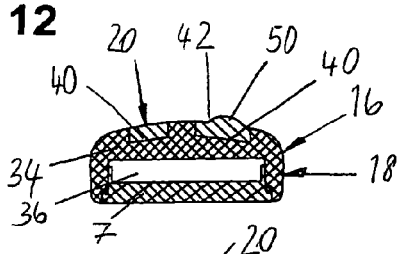
FIGS. 12-17 show cross sections through the toothbrush from FIG. 11 along the sectional planes E12 to E17 depicted in FIG. 11.

FIG. 12 shows a cross section through the head 10 of the toothbrush according to FIG. 11. The hard component 16 has an M-shaped cross section, in the lower recess 36 of which the bristle carrier 7, which is firmly connected to the head part 22 by means of a known technique, is represented without bristles 5. The two upper depressions 40 are filled with the soft component 20. The soft component 20 forms the already described tongue scraper 42 there on the surface. Above the channel on the right, a scraper protuberance 50 of the tongue scraper 42 is sectionally illustrated.

Figure 13:
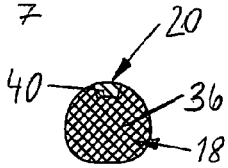

FIG. 13 shows a virtually circularly rounded cross section through the neck 12 of the toothbrush along the sectional plane E13. The cross section is virtually completely filled by the base structure 18. Only the channel-like depression 40 is filled with the soft component 20. The channel-like depression 40, which extends from the grip part 26 to the head part 22, offers the technical advantage that, when an injection-molding technique is used, only a single injection point is required on the toothbrush to apply the entire soft component 20.

Figure 14:
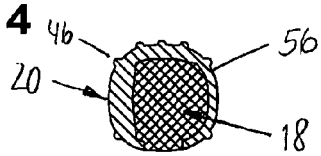

FIG. 14 shows in section a part of the start of the neck that is enclosed virtually completely by the soft component 20, with a peripheral line 56 which has bulges corresponding to the sectioned surface structure 46 of the soft component 20. The base structure 18 is integrally formed asymmetrically in cross section and contributes to the already described, asymmetric flexural rigidity with respect to the longitudinal axis of the toothbrush.

Figure 15:
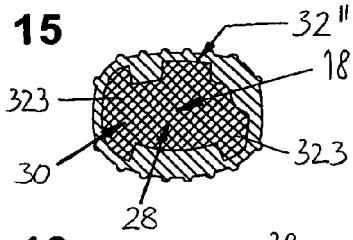

Shown in FIG. 15 is a section through the grip 14 in the region of the rest for the thumb 58, near the widening 44 lying in the direction of the head 10. The cross section, which is flattened with respect to the upper side and underside of the toothbrush and is comparable with a rounded rectangle, makes adequate use of the toothbrush possible even in the case of a holding position that is turned for example through 90° about the longitudinal axis. The base structure 18 enclosed by the soft component 20 has the following sectionally illustrated elements: in the region on the left, a section through a rib 323, in the upper region the stub-like raised part 32" and on the right a further sectionally illustrated rib 323. The asymmetrically arranged extensions 323, 32" in this case protrude from the core 28 without any transition.

Figure 16:
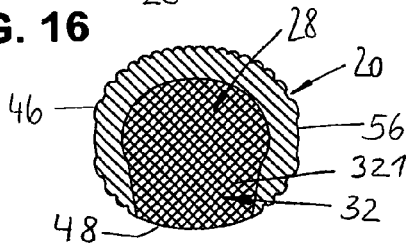

FIG. 16 shows a cross section through the grip 14 at the location of the extension 321. The slightly flattened, but virtually round base form of the cross-sectional area has a peripheral line 56 with bulges corresponding to the surface structure 46. On the upper side of the toothbrush, the peripheral line 56 has a smooth segment, which originates from the island 48 of the extension 321. The extension 321 protrudes from the core 28 without any transition and has a radially outwardly decreasing width.

Figure 17:
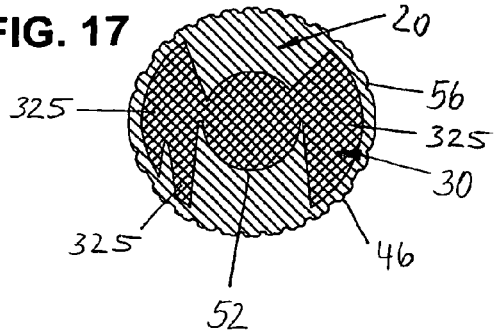

A cross section through the free end region of the grip 14, for instance at a location for resting the ball of the hand, is represented in FIG. 17. The section runs directly through a part-spherical web 52 and ribs 325 that are connected to it to the right and left without any transition and are offset asymmetrically one behind the other in the longitudinal direction. The section through the completely enclosing soft component 20 shows in turn a peripheral line 56 with bulges corresponding to the sectionally illustrated surface structure 46.

In FIG. 18 to FIG. 27*b*, further preferred embodiments of the surface structure 46 for the grip 14, but optionally also for the neck 12 and/or the head 10, are indicated. They show in FIG. 18 to FIG. 27 plan views of details of the surface structure 46 of grips 14, in FIG. 18*a* to FIG. 27*a* cross sections of the details along the sectional planes designated in FIG. 18 to FIG. 27 by E18 to E27 and in FIG. 18*b* to FIG. 27*b* perspective representations of the details shown in FIGS. 18 to 27.

All the embodiments of surface structures 46 shown in FIG. 18 to FIG. 27*b* have elements oriented in the transverse direction of the toothbrush, in order to prevent the hand from slipping off in the longitudinal direction of the toothbrush during use.

Figure 18:
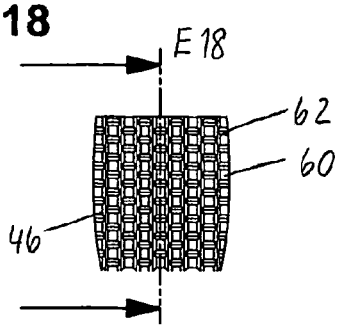
FIGS. 18-27 show details from plan views of gripping surfaces of toothbrushes with various surface structures of the soft component.
Figure 18A:
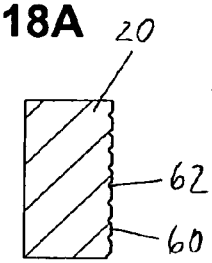
Figure 18B:
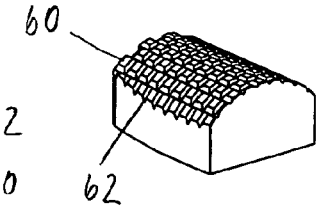

Represented in FIG. 18 is a regular surface structure 46 of truncated pyramids 60 with rectangular base areas that follow closely one after the other and are offset with respect to one another. The arrangement forms a network of channels 62 with a wedge-shaped cross section. These channels 62 drain liquids, for example water, away from the grip 14 of the toothbrush during use of the toothbrush. As a result, the tops of the truncated pyramids 60 that come into contact with the hand during use remain relatively dry and an increased static friction between the tops and the surface of the hand prevents the hand from slipping off from the grip 14. With the structures of the skin, the sloping side faces and upper edges of the truncated pyramids 60 additionally form resting contacts with positive engagement, which likewise contribute to preventing slipping off.

Figure 19:
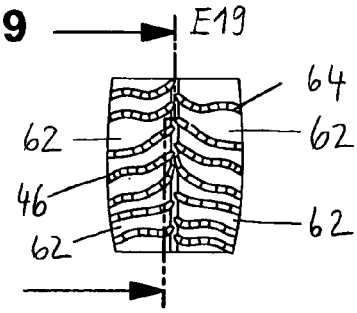
Figure 19A:
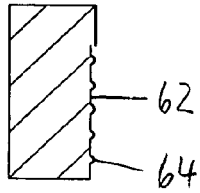
Figure 19B:
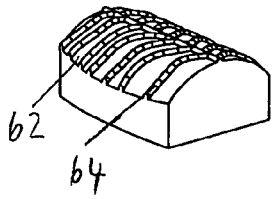

FIG. 19 shows irregularly running beads 64 of semicircular cross sections, approximately pointing away from a common line. The beads 64 form together with the smooth underlying surface channels 62 for draining liquids away. At the same time, the raised parts 64, interacting with the skin with positive engagement, prevent the hand from slipping off from the grip 14.

Figure 20:
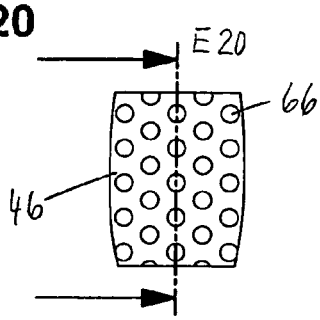
Figure 20A:
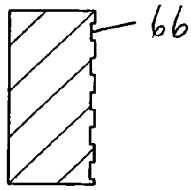
Figure 20B:
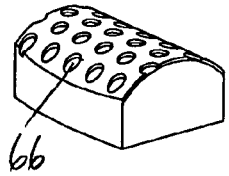

Shown in FIG. 20 is a surface structure 46 which has cylindrical depressions 66 regularly offset with respect to one another. These blind holes 66 form small cavities, which bring about a suction effect after slight pressure is exerted when they are gripped and covered over with the hand. In this way, slipping of the hand on the gripping surface is likewise reduced.

Figure 21:
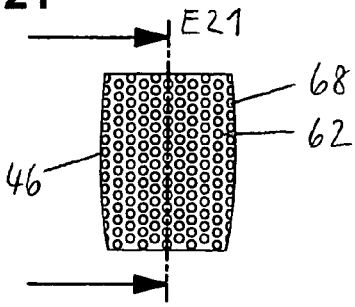
Figure 21A:
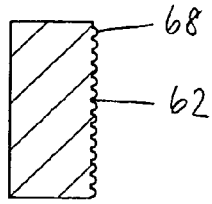
Figure 21B:
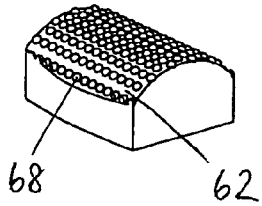

Depicted in FIG. 21 is a surface structure 46 with a large number of hemispheres 68, formed prominently in the manner of protuberances. By their regular, mutually offset arrangement, they form channels 62 for liquids. In interaction with the surface of the skin, slipping of the hand on the gripping surface is in turn reduced by positive engagement.

Figure 22:
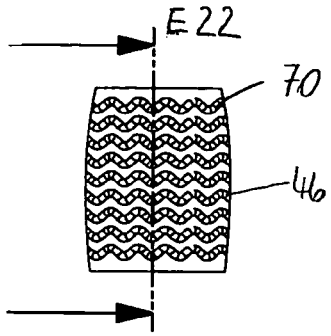
Figure 22A:
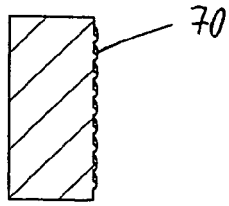
Figure 22B:
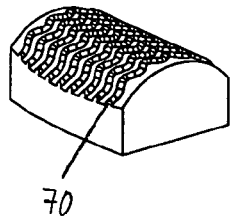

FIG. 22 shows an embodiment in which wave-form, recurring, segmented elevations 70 are arranged perpendicular to the longitudinal axis of the grip 14 at equal intervals parallel to one another. The structure is similarly suitable for draining liquids away and likewise has the effect of mechanically reducing slipping.

Figure 23:
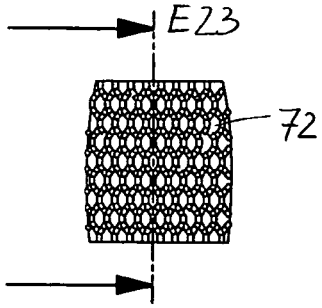
Figure 23A:
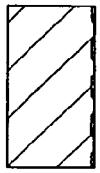
Figure 23B:
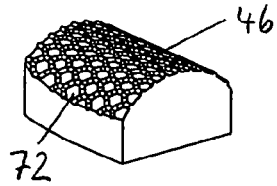

In the case of the embodiment depicted in FIG. 23 and already shown in the toothbrushes according to FIG. 5 FIG. 11, segmental elevations form on the surface a honeycomb lattice structure of cells 72 with round or hexagonally sunken base areas. This configuration has the effect in particular of mechanically reducing slipping, additionally assisted by the already described suction effect.

Figure 24:
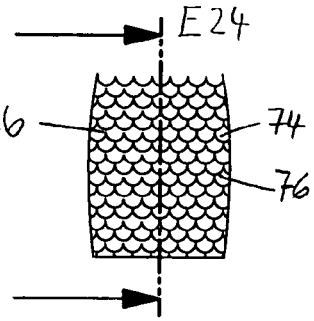
Figure 24A:
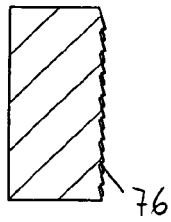

In FIG. 24, a scale-like surface structure 46 is shown. In a regularly offset arrangement, scales 74 facing toward the free end of the grip 14 partly overlap scales preceding them at an angle of approximately 40°. They form rear sides 76 that are upright virtually at right angles from the surface of the grip 14 and prevent the hand from slipping in the direction of the head 10. The surface structure 46 is likewise suitable in an advantageous way for draining liquids away over the grip 14.

Figure 25:
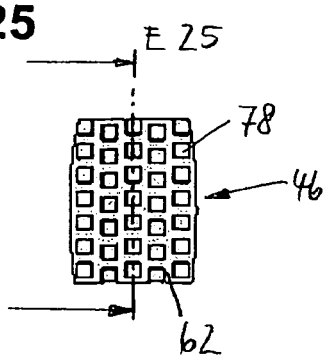
Figure 25A:
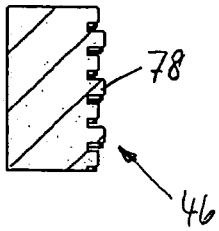
Figure 25B:
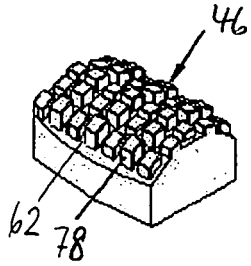

In FIG. 25, FIG. 25*a* and FIG. 25*b*, a surface structure 46 with a number of cuboids 78 projecting to different heights is depicted. As can be seen in particular in FIG. 25*b*, the radially outer cuboid faces may in this case be beveled. Formed between the cuboids 76 are channels 62 for draining liquids away.

Figure 24B:
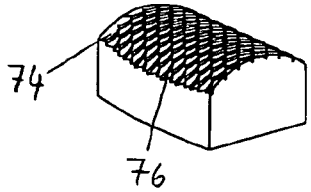
Figure 26:
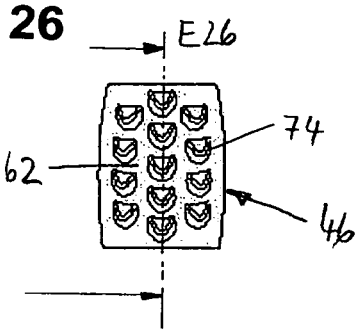
Figure 26A:
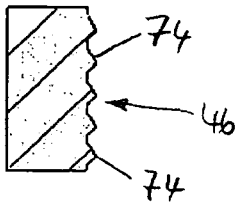
Figure 26B:
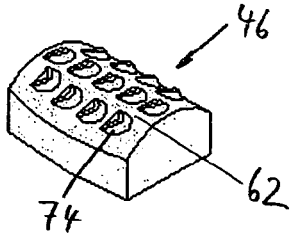

FIG. 26, FIG. 26*a* and FIG. 26*b* show a further configuration of a scale-like surface structure 46. By contrast with the scale formation represented in FIG. 24-FIG. 24*b*, here the scales 74 are arranged in isolation and offset from one another in rows. The scales 74, spaced apart from one another, also have the effect in this case of forming channels 62 for draining liquids away.

Figure 27:
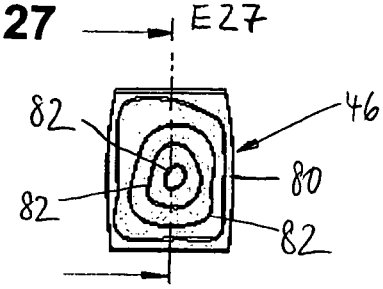
Figure 27A:
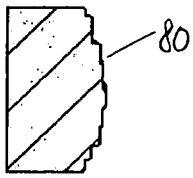
Figure 27B:
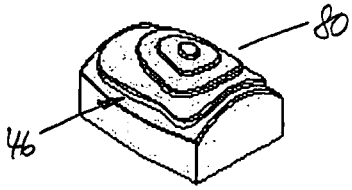

In FIG. 27, FIG. 27*a* and FIG. 27*b*, views of a surface structure 46 with a height gradation 80 are represented. In the plan view of FIG. 27, the encircling boundary surfaces of the individual grades of the height gradation 80 form four contour lines 82, as are known for example from cartography. The contour lines 82 are preferably rounded and surround simple, convex, unfractured basic forms. The outermost contour line with the greatest circumference preferably has a rectangular-rounded shape; the centrally inner contour line preferably has a virtually round form. As shown in FIG. 27*a*, this corresponds to a height profile with the highest, virtually central point or plateau. Height gradations 80 of this type may be arranged next to one another, so that channels 62 are formed in the "valleys" between the height gradations 80. Of course, the height gradations 80 may reproduce the widest variety of forms of elevations and also have a different number of grades.

All the described surface structures 46 may vary in the size, height and spacing or interval of their smallest, recurring basic elements (truncated pyramid 60, bead 64, cylindrical depression 66, hemisphere 68, wave-form elevation 70, honeycomb cell 72, scale 74, cuboid 78, height gradation 82) on the surface of a grip 14, but of course also between grips 14 of different toothbrushes. The spacing and the height of the basic elements 60, 64, 66, 68, 70, 72, 74, 78, 82 is less than 5 mm and is preferably 0.5 mm to 2 mm. The basic elements 60, 64, 66, 68, 70, 72, 74, 78, 82 of the surface structures 46 may be partly or completely replaced by their negative form, that is to say an elevation may be replaced by its depression etc., or other forms. Their extents are preferably made to stretch along the side faces of the toothbrush and are consequently greater than on the upper side and underside of the toothbrush. On the side faces, the basic elements 60, 64, 66, 68, 70, 72, 74, 78, 82 preferably have no raised parts that protrude beyond lateral tangential faces running parallel to the longitudinal axis of the toothbrush and the bristles 5.

In an alternative embodiment, the described surface structures 46 may also be used on an electric toothbrush. Provided in the grip 14 and neck 12, these have the advantage there of absorbing mechanically produced vibrations. Surface structures 46 provided on the head 10 likewise form a highly effective massaging and cleaning surface, in particular whenever they are located on a movable surface of the electric toothbrush. This is the case for example when they are provided on the surface, preferably the rear side, of a brush head that is made to vibrate or rotate by means of vibrations or rotations. Combined provision of the surface structures 46 both on movable surfaces and on fixed surfaces of the electric toothbrush is particularly advantageous.

The production of the toothbrush body 1 according to the invention or the toothbrush according to the invention preferably takes place in a multi-step injection-molding process. In this case, firstly the base structure 18 is produced from the hard component 16, preferably by means of a single injection point. This injection point advantageously lies in the rear third of the grip part 26, at an extension 32" covered over by the soft component 20. Alternatively, the base structure 18 may also be cast in a multi-component process from two or more, for example colored, hard components 16. In this step, lettering, symbols etc. may already be formed on the hard component or by the hard component itself.

Subsequently, one or more soft components 20 is or are molded onto the base structure 18. At least one of the soft components 20 is transparent or translucent. The soft component 20 may in this case be colored or colorless and likewise used for the provision or application of letters, symbols or other formations.

Figure 28:
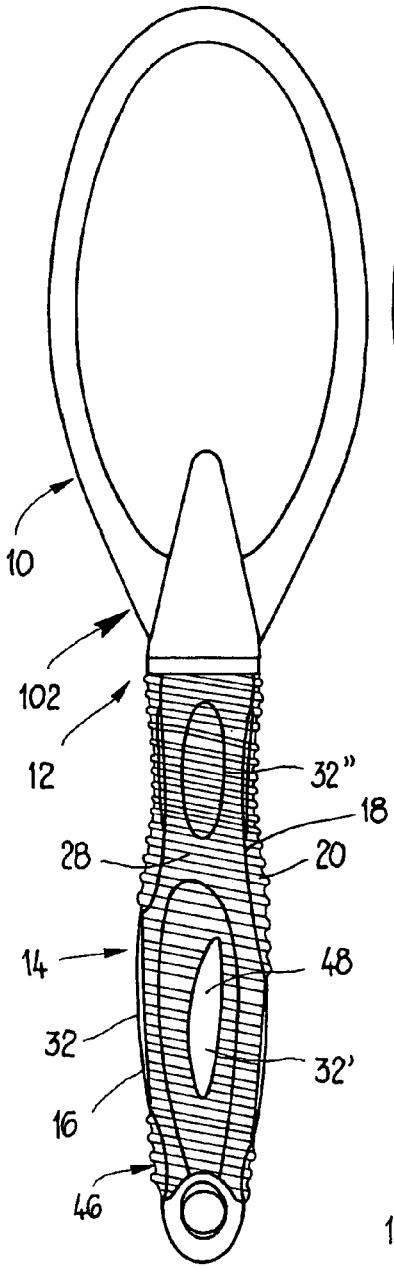
FIGS. 28-30 show plan views of the underside and the upper side and also a side view of a hairbrush with a handle body according to the invention.
Figure 29:
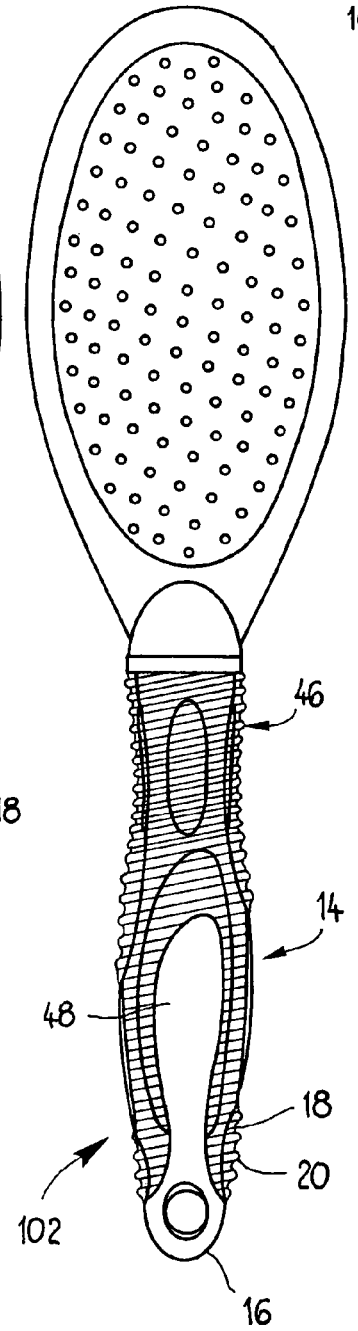
Figure 30:
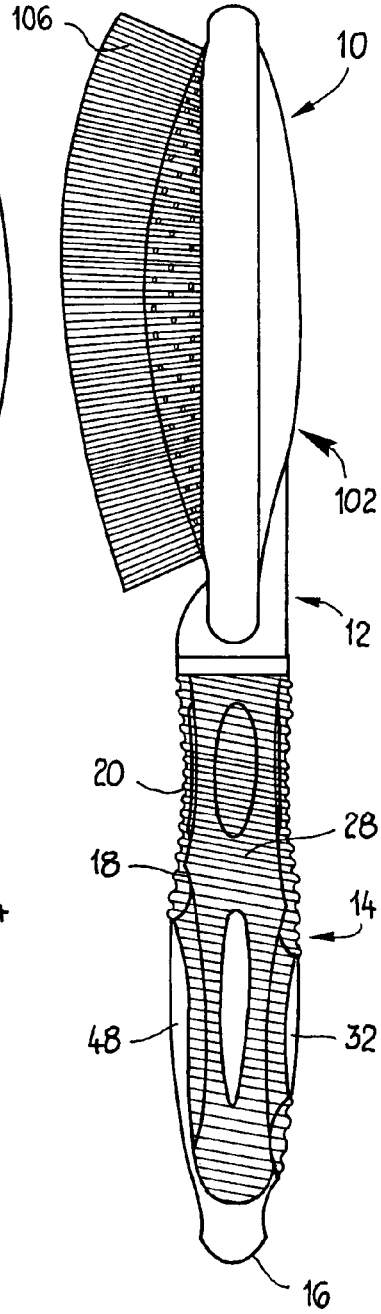
Figure 31:
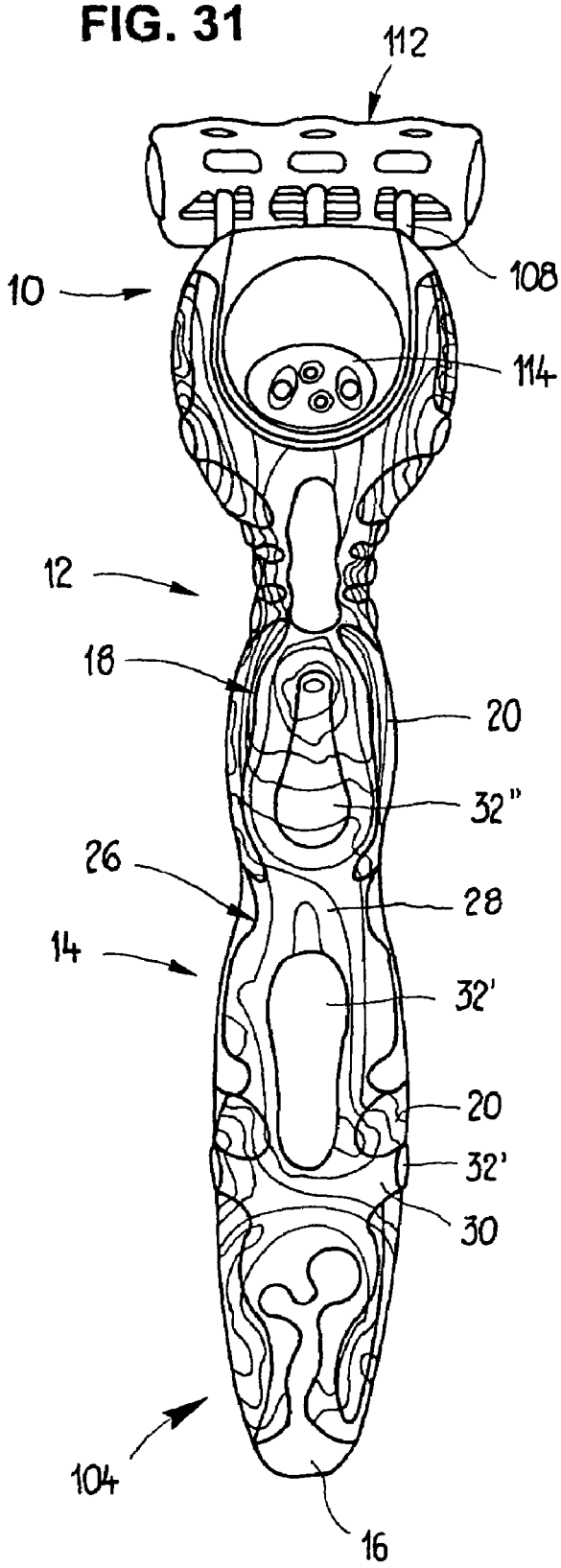
FIGS. 31-32 show a plan view and a side view of a razor with a handle body according to the invention.
Figure 32:
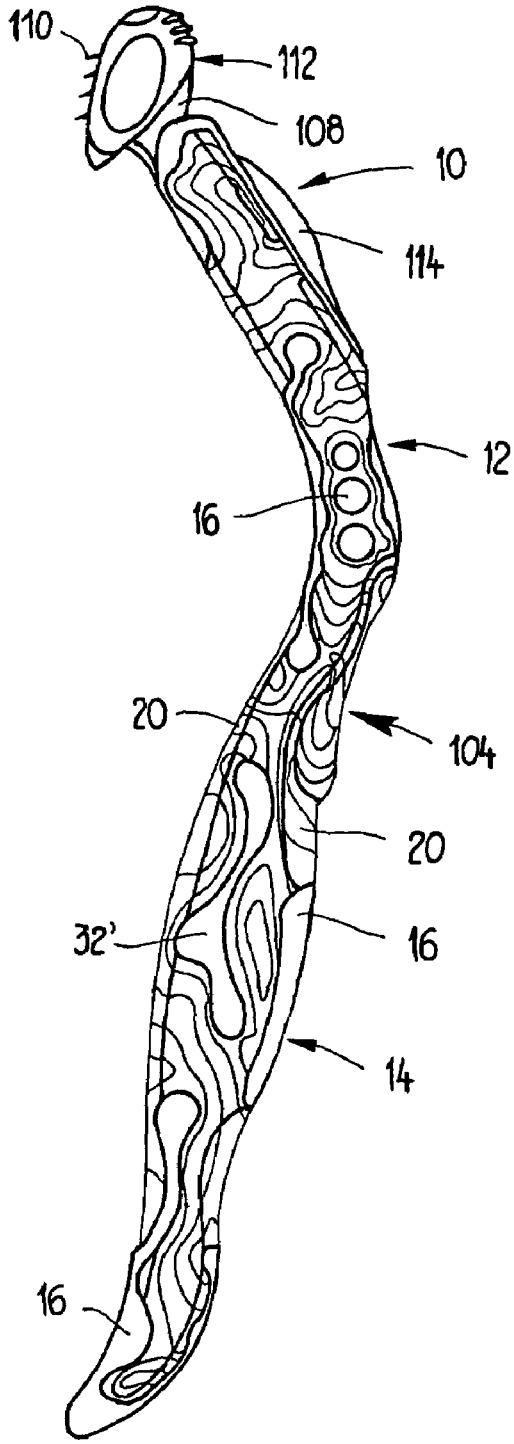

In a further working step, the bristles 5 are secured on a bristle carrier 7 by means of the AFT (anchor free tufting) process, the IMT (inmold tufting) process or a conventional tufting process. Subsequently, a bristle carrier 7 provided with bristles is inserted into the receptacle on the head 10 and cemented or cast in there, or is secured by means of some other known technique. The features described for the toothbrush body 1 according to the invention or the toothbrush according to the invention and the associated production processes may of course also be used for other brush products and more generally for any kind of implements with handles. In particular for body care implements, such as a hairbrush 102, shown in FIG. 28 to FIG. 30, and a razor 104, represented in FIG. 31 and FIG. 32, the features described above can be applied. Accordingly, with these configurations it is also the case that the head 10, the neck 12 and the grip 14 adjoining it have at least the hard component 16, which is formed as a base structure 18 for receiving and supporting the soft component 20. In these configurations, too, the base structure 18 is of a skeletal form and has a grip part 26 with an elongate, spinal core 28, arranged in the grip 14, with protruding extensions 30, 32, 32', 32" in the form of ribs 30 and/or stump-like raised parts 32, which form open spaces filled with the soft component 20.

The handle body of the hairbrush 102 has at the head 10 individual or clustered-together further bristles 106 and/or tines, which may have different degrees of hardness and colors.

The handle body of the razor 104 additionally has at its head 10 a razor blade unit 112, which is mounted in an oscillating or fixed manner by means of a releasable or unreleasable holder 108 and receives at least one razor blade 110. On the head 10 there is also an arresting-releasing mechanism 114, which allows the razor blade unit 112 to be released from the head 10 and, if need be, exchanged.

What is claimed is:

1. A handle body for a body care implement, comprising:

a head;

a neck;

a grip adjoining the neck; and at least one hard component formed as a base structure for receiving and supporting at least one soft component, wherein the base structure is of a skeletal form and has a grip part with an elongate, spinal core arranged in the grip with protruding extensions in the form of ribs, which form open spaces therebetween filled with the soft component, wherein the ribs are entirely covered radially with respect to a longitudinal direction of the core by a film-like layer of the soft component.

2. The handle body as claimed in claim 1, wherein the core runs centrally in the grip and virtually parallel to a longitudinal axis of the body.

3. The handle body as claimed in claim 1, wherein the extensions are arranged offset with respect to one another in a longitudinal direction of the grip.

4. The handle body as claimed in claim 1, wherein the ribs are formed asymmetrically with respect to a longitudinal axis of the core and that the raised parts are formed asymmetrically.

5. The handle body as claimed in claim 1, wherein the core is formed between the extensions as a web that is weakened in comparison with a maximum cross section of the core to form a flexible zone.

6. The handle body as claimed in claim 5, wherein the web has a shape of a partial cylinder or sphere.

7. The handle body as claimed in claim 1, wherein the soft component fills the spaces of the base body and at least partly covers over the extensions, a maximum radial layer thickness of the soft component being 10 mm.

8. The handle body as claimed in claim 1, wherein the extensions are covered radially with a substantially constant thickness of less than 4 mm.

9. The handle body as claimed in claim 8, wherein the thickness is approximately 1 mm.

10. The handle body as claimed in claim 1, wherein radial outer faces of additional extensions in the form of stump-like raised parts form islands on the surface of the body with an area greater than 2 mm×2 mm, which have continuous, stepless and shoulderless transitions with respect to the surrounding soft component.

11. The handle body as claimed in claim 10, wherein the surface of the islands is at least partly smooth or structured in the manner of a network, honeycomb, channels, scales or protuberances with recurring basic elements in the form of truncated pyramids, beads, cylindrical depressions, hemispheres, wave-form elevations, honeycomb cells, scales, cuboids or height gradations.

12. The handle body as claimed in claim 11, wherein the structures of the surfaces of the islands and the surface structures from the soft component vary in their size and height and are elongated along the side faces of the handle body at the periphery transversely to a longitudinal direction of the handle body.

13. The handle body as claimed in claim 10, wherein the islands have an area of 4 mm×4 mm.

14. The handle body as claimed in claim 1, wherein a predominant part of the surface of the soft component in a region of the grip is structured in the manner of a network, honeycomb, channels, scales, grades or protuberances with recurring basic elements in the form of truncated pyramids, beads, cylindrical depressions, hemispheres, wave-form elevations, honeycomb cells, scales, cuboidsor height gradations.

15. The handle body as claimed in claim 1, wherein the soft component is transparent or translucent and/or slightly colored causing the extensions that are covered over by the soft component and the depth of the open spaces that are formed by the base structure to be seen or perceived.

16. The handle body as claimed in claim 1, wherein the core of the base structure is extended from the grip part into a neck part and a head part, and the neck part is provided with mutually offset, asymmetrically arranged indentations.

17. The handle body as claimed in claim 1, wherein the degree and direction of flexural rigidity of the handle body vary along a longitudinal axis of the body, even at locations with approximately the same diameter of the cross section of the handle body, on account of different volumes of the spaces formed by the extensions and different distances between the extensions.

18. A toothbrush body with a handle body as claimed in claim 1, wherein the head has on an underside opposite from a recess, a tongue scraper formed from the soft component, with scraper protuberances having an elliptical or circular base area and a part-circular scraper area with a spoon-like concavity.

19. A toothbrush with a handle body as claimed in claim 1, wherein the head defines a toothbrush body with bristles together in bristle clusters.

20. The toothbrush as claimed in claim 19, wherein the bristles together in bristle clusters have different degrees of hardness and colors.

21. A hairbrush with a handle body as claimed in claim 1, wherein the handle body has at the head individual or clustered-together further bristles and/or tines.

22. The hairbrush as claimed in claim 21, wherein the bristles and/or tines have different degrees of hardness and colors.

23. A razor with a handle body as claimed in claim 1, wherein the handle body is provided at the head with a razor blade unit that is mounted in an oscillating or fixed manner and has at least one razor blade, a holder for the razor blade unit and/or an arresting-releasing mechanism for the razor blade unit.

24. A handle body for a body care implement, comprising:

a head;

a neck;

a grip adjoining the neck; and at least one hard component formed as a base structure for receiving and supporting at least one soft component, wherein the base structure is of a skeletal form and has a grip part with an elongate, spinal core arranged in the grip with protruding extensions in the form of ribs and/or stump-like raised parts, which form open spaces filled with the soft component, and wherein the ribs are formed asymmetrically with respect to a longitudinal axis of the core and the raised parts are formed asymmetrically.

25. A handle body for a body care implement, comprising:

a head;

a neck;

a grip adjoining the neck; and at least one hard component formed as a base structure for receiving and supporting at least one soft component, wherein the base structure is of a skeletal form and has a grip part with an elongate, spinal core arranged in the grip with protruding extensions in the form of ribs and/or stump-like raised parts, which form open spaces filled with the soft component, wherein the head has on an underside opposite from a recess, a tongue scraper formed from the soft component, with scraper protuberances having an elliptical or circular base area and a part-circular scraper area with a spoon-like concavity.

* * * * *